US005887451A

United States Patent [19]

Suzuki

[11] Patent Number: 5,887,451

[45] Date of Patent: Mar. 30, 1999

[54] FLAT BED KNITTING MACHINE METHOD FOR FORMING TUBULAR FABRIC WITH JACQUARD PATTERN

[75] Inventor: Masato Suzuki, Wakayama, Japan

[73] Assignee: Shima Seiki Mfg., Ltd., Wakayama, Japan

[21] Appl. No.: 897,275

[22] Filed: Jul. 21, 1997

[30] Foreign Application Priority Data

Aug. 1, 1996 [JP] Japan ..... 8-203707

[51] Int. Cl.[6] ..... D04B 1/24

[52] U.S. Cl. ..... 66/64; 66/176

[58] Field of Search ..... 66/64, 176

[56] References Cited

U.S. PATENT DOCUMENTS

| | | | |
|---|---|---|---|
| 3,474,643 | 10/1969 | Robinson et al. | 66/176 |
| 3,685,316 | 8/1972 | Robinson et al. | 66/64 |
| 5,379,615 | 1/1995 | Shima . | |
| 5,444,995 | 8/1995 | Benetton | 66/64 |

FOREIGN PATENT DOCUMENTS

| | | |
|---|---|---|
| 4-15301 | 3/1992 | Japan . |
| 4-153346 | 5/1992 | Japan . |
| 7-238445 | 9/1995 | Japan . |
| 8-113853 | 5/1996 | Japan . |
| 2 228 750 | 9/1990 | United Kingdom . |

*Primary Examiner*—Andy Falik

*Attorney, Agent, or Firm*—McAulay Nissen Goldberg Kiel & Hand, LLP

[57] ABSTRACT

A method of knitting a knit-in rib or tubular jacquard of a double-jersey weave into a tubular body free or substantially free of a sewing process by forming a course of loops of either of the front fabric or the rear fabric with knitting needles from a first needle bed. The method includes the steps of transferring the knitted loops of the fabric at its inside portion for the knit-in jacquard to be knitted in to the knitting needles of the second needle bed facing the first needle bed so that the number of fabric wales at its inside portion is half gauge of the fabric at its outside surface, forming a course of knitted loops of the knit-in jacquard by using the needles of the first and second needle beds retaining the fabric knitted loops, transferring the knitted fabric loops of the inside portion formed with the needles of the second needle bed back to the knitting needles of the first needle bed facing the second needle bed, and knitting courses of knitted loops of the other of the front fabric and the rear fabric. The above steps are repeated to knit the the knit-in jacquard of a double-jersey weave into the tubular knitting body.

5 Claims, 5 Drawing Sheets

FLAT BED KNITTING MACHINE METHOD FOR FORMING TUBULAR FABRIC WITH JACQUARD PATTERN

BACKGROUND OF THE INVENTION

This invention relates to a method of knitting a tubular knitting fabric whose front side knitting fabric and rear side knitting fabric are knitted together at their side edges by using a flat knitting machine having at least a pair of spaced apart, opposite, front and rear needle beds. Specifically, this invention relates to a method of knitting a knit-in jacquard of a double-jersey weave, such as a tubular jacquard and a rib jacquard, in which courses of knitted loops are knitted with the needles of the front and rear needle beds, in the form of a tubular body.

Recently, attention has been attracted to a method of knitting bodies and sleeves into a tubular form with a flat knitting machine and knitting the bodies and sleeves together during the knitting to thereby produce a sweater in a substantially finished product when the knitted fabric is removed from the knitting machine. This method is advantageous in that with front sides of the sleeves and a front side of the body of the sweater retained in the front needle bed and rear sides thereof retained in the rear needle bed, a substantially tubular formed knitting fabric whose front and rear sides are knitted together at their side edges can be knitted. This method requires no sewing process or requires only a slight sewing process, if any, thus providing an advantage that troublesome work is reduced. Further, since this method provides no sewn portion, it has an advantage that elasticity, the characteristic of the knit, is not impaired. This manufacturing system is applicable not only to sweaters but also to various kinds of knitted clothing which are generally called non-sewn knit. This method is disclosed by Japanese Patent Publication No. Hei 4(1992)-15301 and Japanese Laid-Open Patent Publications No. Hei 4(1992)-153346 and No. Hei 8(1996)-113853. These publications disclose the weave of the knitting fabric of the tubular body mainly composed of a plain weave, and as the weave of the knitting fabric used therein, a pattern of the weave such as a cable stitch and a links-and-links pattern was of general interest. In addition, Japanese Patent Application No. Hei 8(1996)-150565 which is now pending discloses that the subject matter is a method of knitting a tubular body of an intersia pattern.

Japanese Patent Publication No. Hei 7(1995)-238445 discloses a method of knitting a knit-in jacquard into a tubular body, which relates to the subject matter of the invention. However, the knit-in jacquard disclosed therein is what is called a plain stitch jacquard. With the plain stitch jacquard, the knitting fabric at a side thereof for the jacquard to be knitted in is composed of a single-jersey weave which is woven with needles in either of the front or rear needle bed. Thus, this prior art document is totally silent with respect to the double-jersey weave.

The knit-in jacquard stitch, which is often used when a pattern is rendered a knitting fabric design, is knitted using a plurality of knitting yarns of different colors. The knit-in jacquard stitch generally include the rib jacquard, the tubular jacquard and the like, in addition to the plain stitch jacquard. However, it is only Japanese Patent Laid-Open Publication No. Hei 7(1995)-238445 which discloses the method of knitting-a knit-in jacquard into a tubular body. The method of knitting a knit-in jacquard fabric of a double-jersey weave, such as a tubular jacquard and a rib jacquard, into a tubular body with needles from both the front and rear needle beds has been unknown. On the contrary, it has been considered impossible to form such a knitting with the flat knitting machine so far.

In the light of the problems mentioned above, this invention is made. The object of the invention is to provide a method of knitting a tubular jacquard or a rib jacquard in the form of a tubular body with a flat knitting machine.

SUMMARY OF THE INVENTION

To solve the problems mentioned above, the present invention provides for a method of knitting a knit-in jacquard of a double-jersey weave, such as a rib jacquard or a tubular jacquard, using a flat knitting machine into a tubular body whose front fabric and rear fabric are knitted together at their side edges with the flat knitting machine which has at least a pair of first and second needle beds facing each other with a gap, and with each needle bed having knitting needles. The method of the invention comprises the steps of:

forming a course of knitted loops from either the front fabric and the rear fabric with the knitting needles of the first needle bed;

(a) transferring the knitted loops of the inner face of each of the fabrics for a knit-in jacquard to be knitted in to the knitting needles of the second needle bed facing the first needle bed so that the number of wales of the fabric at its inner face is half the gauge of the number of wales of the fabric at its outer face;

(b) forming a course of knitted loops of the knit-in jacquard by using the needles from the first and second needle beds for retaining the knitted loops of the fabric;

(c) transferring the knitted loops of the fabric at its inner face part formed with the needles from the second needle bed back to the knitting needles of the first needle bed facing the second needle bed; and (d) knitting courses of knitted loops of the other of the front fabric and the rear fabric, and repeating the steps (a)–(d) to knit the knit-in jacquard of a double-jersey weave into the tubular knitted body.

The same knitting procedure including the above steps (a)–(c) is applied to the other fabric of the tubular body retained by the knitting needles of the second needle bed, so that the knit-in jacquard is knitted to from both the front and rear fabrics of the tubular body.

The flat knitting machine used is a flat knitting machine having a pair of front and rear needle beds facing each other with a gap therebetween and wherein knitted loops are assigned to needles of the first and second needle beds so that the knitted loops of the fabric formed at its outer face part coming for the knit-in jacquard to be knitted in can be formed with every other needle of the first needle bed and knitted loops of the fabric at its inner face formed with every three needles of the second needle bed opposite to the first needle bed.

The flat knitting machine used is a flat knitting machine having two pairs of front and rear needle beds each having two vertically aligned upper and lower needle beds and facing each other with a gap therebetween and wherein knitted loops of the fabric at its outer face for the knit-in jacquard to be knitted in are formed with a series of needles from the lower needle beds in one of the pair of the front and rear needle beds and knitted loops of the fabric at its inner face is formed with every other needle from the upper needle beds of the other pair of the front and rear needle beds, the knitted loops of the knitting fabric at its inner face is transferred between the upper needle beds of the pair of front and rear needle beds.

Thus, since the wales are assigned to needles of each of the needle beds so that the number of wales of the fabric at its inner face for the knit-in jacquard to be knitted in can be half the gauge of the number of wales of the fabric at its outer face, the knit-in jacquards of a double jersey weave can be knitted into either or both of the front fabric and the rear fabric of the tubular body.

DETAILED DESCRIPTION OF THE PREFERRED EMBODIMENTS

Referring now more specifically to the accompanying figures of the drawings, examples of the preferred embodiments of the invention wherein either a tubular jacquard or a rib jacquard is knitted into bodies of a sweater knitted in a tubular form are described below as a knitting method for a knit-in jacquard composed of a tubular body. It is noted that the term of "a tubular body" used herein is not limited only to a knitting fabric knitted in the form of a complete tubular body whose front fabric and rear knitting fabric are knitted together at both ends thereof, but also includes a knitting fabric whose front and rear bodies are open at one side of the both ends thereof or a knitting fabric whose front body is divided at a center portion thereof similar to a cardigan sweater. Further, while the knitting method of the invention can be worked by any one of the so-called two heads flat knitting machine having a pair of needle beds facing each other with a front and a rear across a needle bed gap or the so-called four heads flat knitting machine having a pair of front and rear needle beds each comprising two vertically aligned upper and lower needle beds and facing each other in front and rear across a needle bed gap, an example using a two heads flat knitting machine is described below.

Embodiment 1

Figure 1:
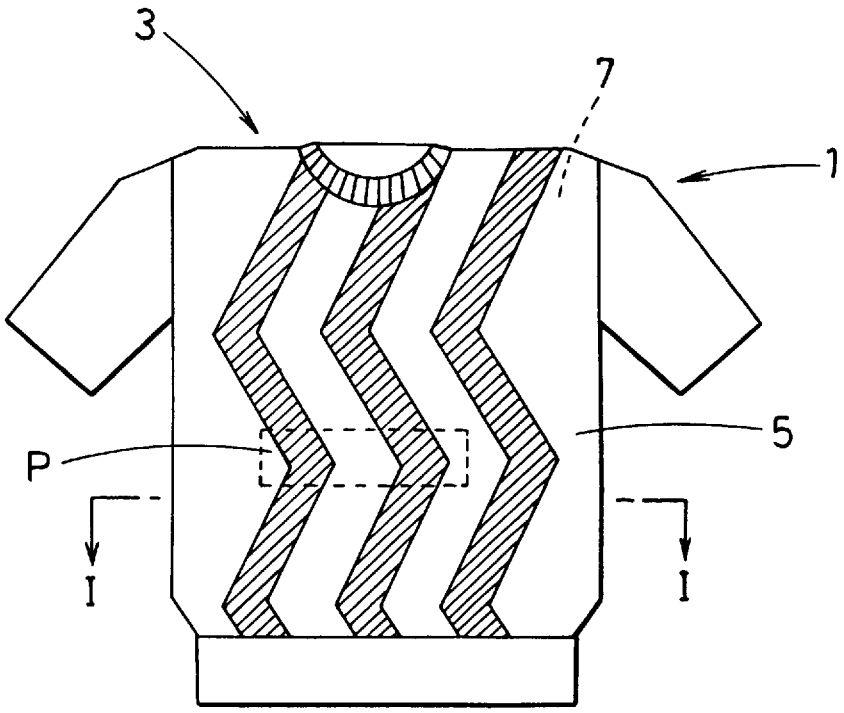
FIG. 1 illustrates a sweater knitted with no sewing room operation.
Figure 2B:
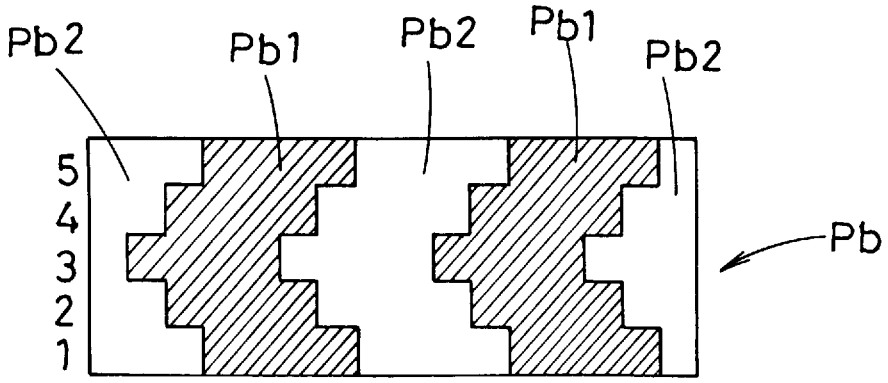
FIGS. 2A and 2B each illustrates is an enlarged view of a part P of a design of a sweater, and FIG. 2A specifically illustrates a pattern of a front body of the sweater and FIG. 2B specifically illustrates a pattern of a rear body of the sweater shown in FIG. 1.
Figure 2A:
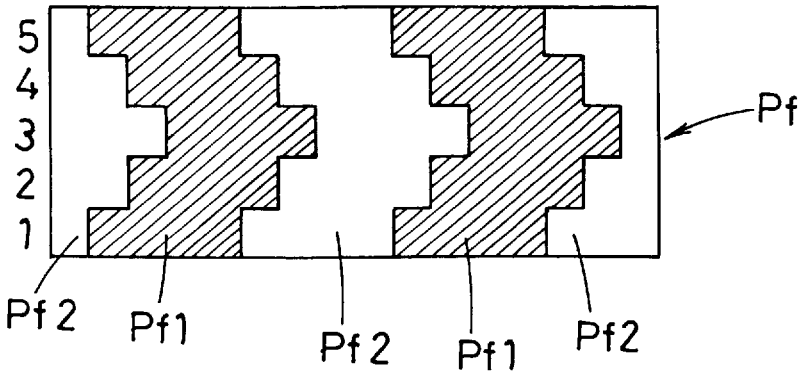
Figure 3:
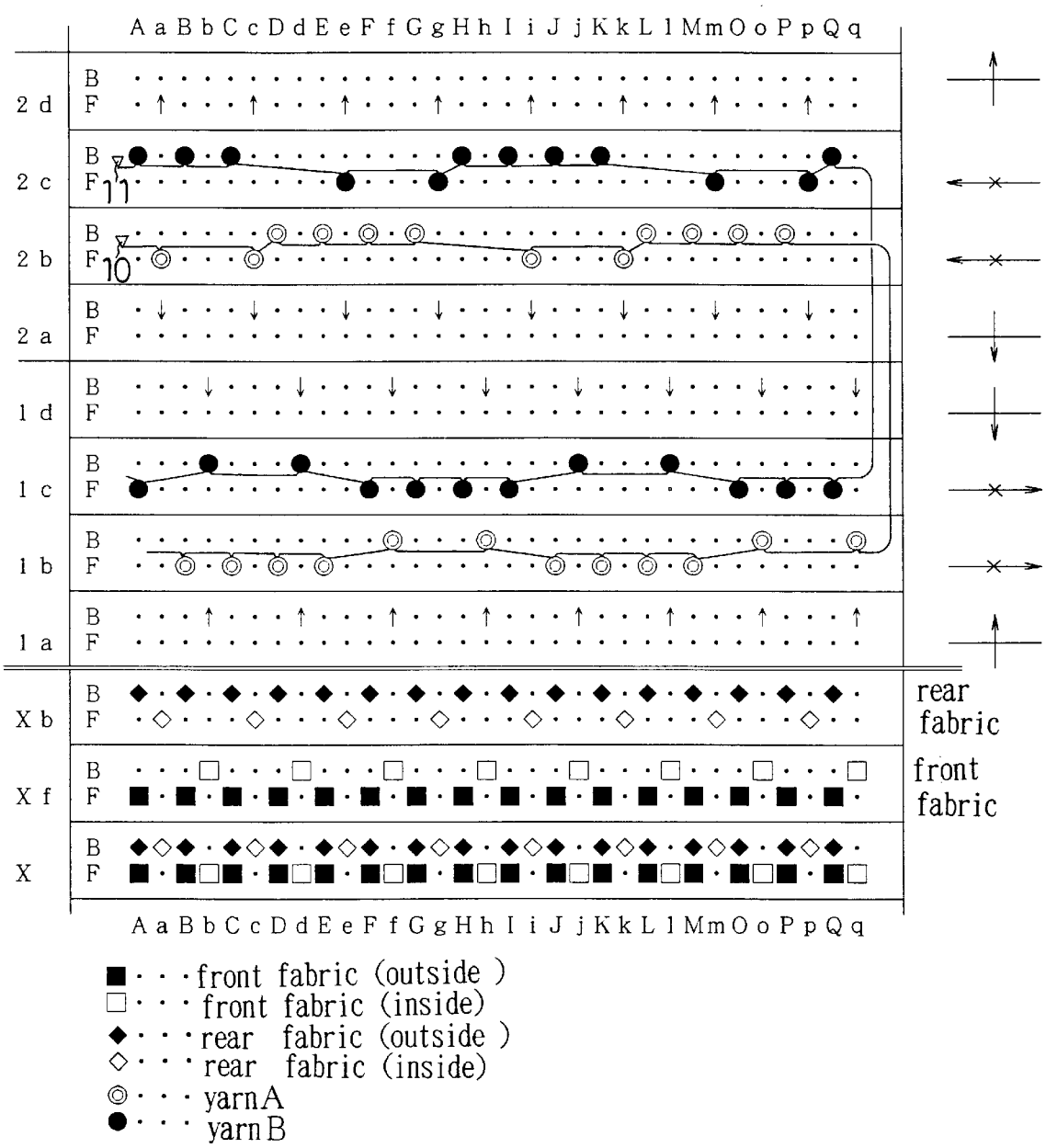
FIG. 3 illustrates a block diagram for knitting of a tubular jacquard of a tubular form of a first embodiment of the invention.

FIG. 1 illustrates a sweater 1 knitted with no sewing room operation. FIGS. 2A and 2B, each shows an enlarged view of a part P of a pattern of a sweater design. FIG. 2A specifically illustrates a pattern for the front body 5; and FIG. 2B specifically illustrates a pattern for the rear body 7. FIG. 3 illustrates a knitting block showing the knitting of a course 1 in the part Pf shown in FIG. 2A and Part Pb shown in FIG. 2B. The ALPHABETS F, B at a left side for FIG. 3 represent a front needle bed and a rear needle bed, respectively, and capital letters A, B, C . . . represent the needles of odd numbers and small letters a, b, c . . . represent the needles of even numbers. Orientation of knitted loops and orientation of transfer of the knitted loops are indicated by arrows at the right side of FIG. 3. A small number of needles used in the knitting procedure are just shown, for the sake of explanation.

This embodiment shows a two-color tubular jacquard to be knitted in around a body portion of a sweater knitted in the form of a tubular body. X in the block of FIG. 3 in a first tier at the lowermost part thereof shows the state of knitted loops of a front body 5 (FIG. 1) and knitted loops of a rear body 7 being retained by needles from a front needle bed and needles from a rear needle bed, respectively. Symbols of squares represent the knitted loops of the front body 5 and symbols of rhombuses represent the knitted loops of the rear body 7. Only the knitted loops of each of the bodies marked by white squares and white rhombuses are formed after they are transferred to the opposite needle bed, when courses or rows of laterally lined loops are knitted. These knitted loops are transferred back to the original needle bed after completion of the formation of the knitted loops, for the knitting of a tubular body. Xf in a second tier from the bottom shows the knitted loops of the front body 5 retained in the knitting of the course of the knitted loops, and Xb in a third tier from the bottom shows the knitted loops of the rear body 7 retained in the knitting of the course.

A single-layer knitting fabric which does not form a tubular body, in other words, a known two-color tubular jacquard, is formed by interlacing a first color knitting yarn fed from a yarn feed member in knitted loops in a pattern at an oblique line section with needles of the front needle bed and interlacing the yarn in the knitted loops in the rest of the pattern at the oblique line section with needles of the rear needle bed. The rest of the tubular jacquard is formed in the same manner by interlacing a second color knitting yarn with the needles of the needle beds opposite to those of the first color knitting yarn. The fabric knitted in this way results in a reversible knitted fabric having two reversed color sides and wearable with either side used as the outside or the inside of the garment. The same is true of a tubular jacquard in a tubular body knitted according to the knitting method of the present invention. However, a tubular body of the knit-in jacquard knitted in accordance with the knitting method of the present invention is characterized in that when the tubular body is knitted with a flat knitting machine, the number of wales of the tubular body at its inner face or inside the garment (back) comes to be half the knitting gauge of the number of wales of the tubular body at its outer face or part facing outside of the garment, in other words, the ratio of the former number of wales to the latter number of wales is 2:1.

Figure 4:
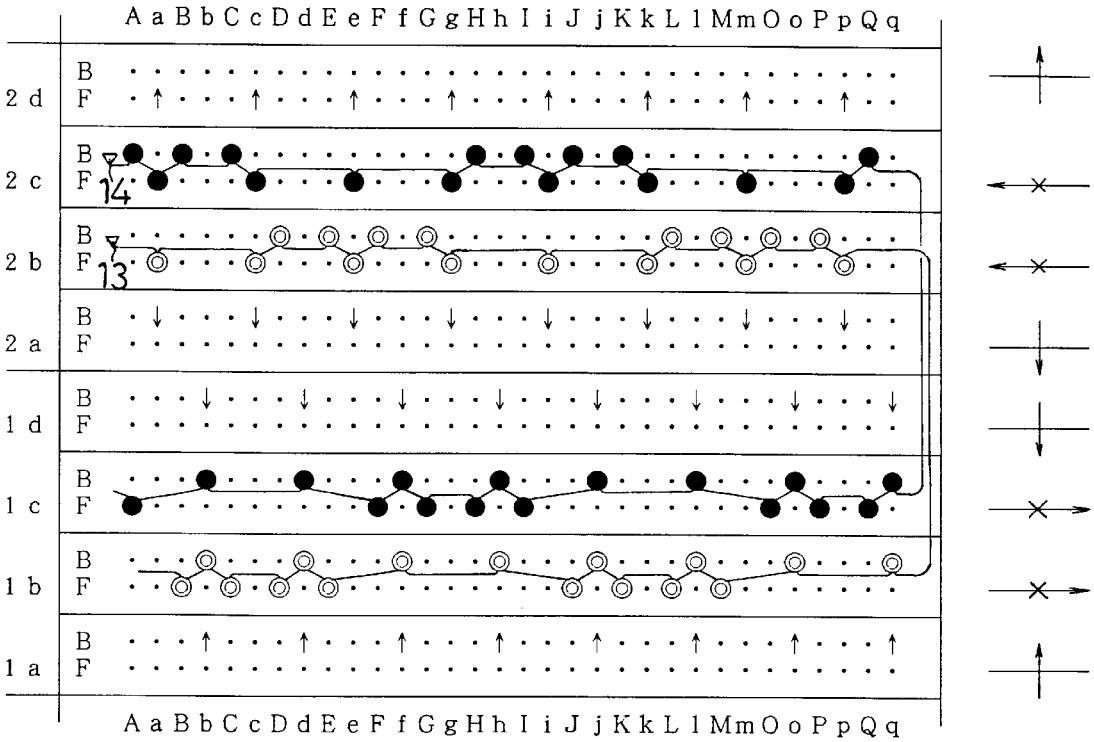
FIG. 4 shows a block diagram for knitting of a rib jacquard of a second embodiment of the invention.
Figure 5:
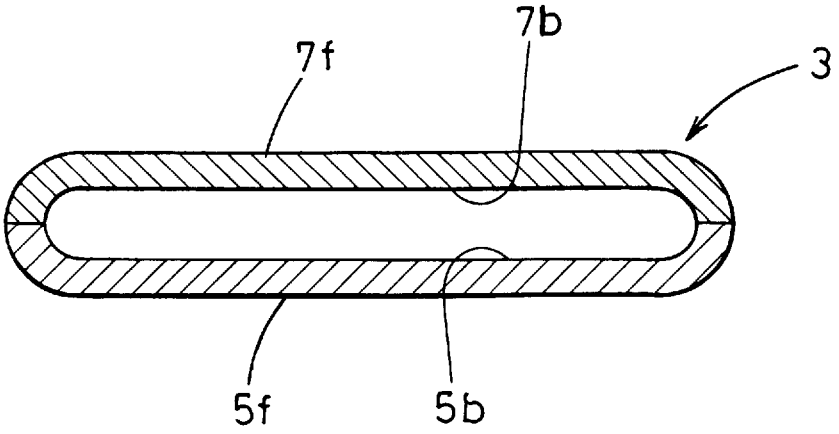
FIG. 5 shows a sectional view of a body portion of the sweater of FIG. 1 taken along line I—I as viewed in the direction of an arrow.

In the stage of the tubular jacquard being knitted with a flat knitting machine, as shown in FIGS. 3 and 5, the knitted loops are assigned to related needles of the respective needle beds. The tubular jacquard of the front body 5 at its part 5*f* (FIG. 5) facing the garment outside when worn is knitted with needles of odd numbers designated by capital or upper case letters A, B, C, . . . O, P and Q of the front needle bed shown horizontally along the bottom and top of FIGS. 3 and 4 and the tubular jacquard of the front body at its part 5*b* hiding inside is knitted with every other needle of even numbers designated with small or lower case letters b, d, f, . . . l, o and q also shown horizontally of the rear needle bed. The tubular jacquard of the rear body 7 at its part 7*f* facing outside when worn is knitted with needles of odd numbers designated with capitol or upper case letters A, B, C, . . . O, P and Q of the rear needle bed and the tubular jacquard of the rear body at its part 7*b* hiding inside is knitted with needles of even number a, c, e, . . . k, m and p of the front needle bed in a phase unused in the knitting of the front body 5.

Next, the knitting in each block of FIG. 3 is described below.

First of all, the blocks 1*a*–1*d* show a course knitting of a tubular jacquard of the front body 5. In the block 1*a*, the knitted loops of the tubular jacquard at its inner face or inside the garment are transferred to needles b, d, f, h, j, l, o and q of the rear needle bed before the course of the loops is formed. Then, in the block 1*b*, a yarn feed member 10 is moved to the right side to feed a first color knitting yarn A onto the needle beds, so that the knitted loops in the part Pf1 at the oblique line section in the course 1 of FIG. 2-A are formed with the needles B, C, D, E, J, K, L, and M of the front needle bed and also the knitted loops of the tubular jacquard at its inner face the garment inside are formed in the form of half gauge with the needles f, h, o and q of the rear needle bed. In the block 1*c*, another yarn feed member 11 is used to feed a second color knitting yarn B to the needles A, F, G, H, I, O, P and Q of the front needle bed relating to a part Pf2 of the same course except the part at the oblique line section, so as to form the knitted loops, while also the needles b, d, j and l of the rear needle bed are used to form the knitted loops of the tubular jacquard at its inner face inside the garment in the form of half gauge. At the point when the course formation of the knitted loops is completed in the above blocks, the knitted loops of the front body 5 are retained as shown in the block Xf. In the block 1*d*, in order to do the course knitting of the rear body 7 following the course knitting of the front body 5, the course knitting that the knitted loops of the front body 5 at its part 5*b* inside the garment, which are knitted with the needles of the rear needle bed, are transferred back to the needles of the opposite front needle bed is done. As a result of this, the knitted loops of the front body 5 are all retained by the needles of the front needle bed (the illustrated state X). During the course knitting of the front body 5, the knitted loops of the rear body 7 are all kept in their retained position by the needles of the rear needle bed.

Next, in the block 2*a*, an array of the knitted loops is made ready for the knitting of the rear body 7 by transferring the knitted loops 7*b* of the rear body at its inner face inside the garment, which are retained by the needles a, c, e, . . . k, m and p of the rear needle bed, to the needles of the front needle bed. In the next block 2*b*, the yarn feed member 10 is moved to the left side to feed the knitting yarn A onto the needle beds, so that the knitted loops in the part Pb1 at the oblique line section in the course 1 of FIG. 2-B are formed with the needles D, E, F, G, L, M, O and P of the rear needle bed and also the knitted loops of the tubular jacquard at its inner face inside the garment are formed in the form of half gauge with the needles a, c, i, and k of the front needle bed. In the block 2*c*, the yarn feed member 11 is used to feed the knitting yarn B to the needles A, B, C, H, I, J, K and Q of the rear needle bed relating to a part Pb2 of the same course except the part at the oblique line section, so as to form the knitted loops, while also the needles e, g, m and p of the front needle bed are used to form the knitted loops of the tubular jacquard at its inner face inside the garment in the form of half gauge. The block Xb of the same figure shows the knitted loops of the rear body 7 being retained at the time of the formation of the knitted loops. In the block 2*d*, in order to knit the course of the front body 5 following the course of the rear body 7, the course knitting that the knitted loops of the rear body 7 at its inner face inside the garment, which are knitted with the needles of the front needle bed, are transferred back to the needles on the opposite rear needle bed is done. As a result of this, the knitted loops of the rear body 7 are all retained by the needles of the rear needle bed. During the course knitting of the rear body 7, the knitted loops of the front body 5 are all kept in their retained position by the needles of the front needle bed.

By establishing the above-mentioned knitting of the blocks 1 and 2 as basic cycles to be applied to the sequential course knitting and repeating the cycles, the tubular jacquard fabric of the tubular body whose front body 5 and rear body 7 are knitted together at their opposite ends can be knitted.

Embodiment 2

Next, an embodiment 2 of a knit-in jacquard in which a two-color rib jacquard is knitted in a body of a sweater knitted in the form of a tubular body is described below. This embodiment 2 is equivalent to the above-mentioned embodiment (FIGS. 1, 2A and 2B) in the sweater to be knitted and in the jacquard design to be knitted in the sweater. FIG. 4 shows a knitting block of the rib jacquard corresponding to FIG. 3. In this embodiment also, when the tubular body is knitted with a flat knitting machine, the number of wales of the tubular body at its inner face inside the garment comes to be half knitting gauge of the number of wales of the tubular body at its face forming the outside, of the garment just as in the case of the embodiment 1. FIG. 4 shows an example using what is called a full backing in which the number of courses of the tubular body at its inner face inside the garment are formed in the relative proportion of 2:1 to the number of courses of the tubular body at its outer face or part facing outside of the garment.

If Kanoko (the alternate tacking in orientations of courses and wales) is used instead of the full backing, the relative proportion of the number of courses of the front to that of the back can be 1:1.

Next, the knitting in each block of FIG. 4 is described below.

Block group 1 is composed of blocks 1*a*, 1*b*, 1*c* and 1*d*.

First of all, the block 1 shows a course knitting of a rib jacquard of the front body 5. In the block group 1*a*, the knitted loops of the rib jacquard at its part hiding inside are transferred to needles b, d, f, h, j, l, o and q of the rear needle bed before the course of the loops is formed. Then, in the block 1*b*, a yarn feed member 13 is moved to the right side to feed a first color knitting yarn A onto the needle beds, so that the knitted loops in the part Pf1 at the oblique line section in the course 1 of FIG. 2-A are formed with the needles B, C, D, E, J, K, L, and M of the front needle bed and also the knitted loops of the rib jacquard at its part hiding inside are knitted into rib stitch in the form of half gauge with the needles b, d, f, h, j, 1, o and q of the rear needle bed. In the block 1*c*, another yarn feed member 14 is used to feed a second color knitting yarn B to the needles A, F, G, H, I, O, P and Q of the front needle bed relating to a part Pf2 of the same course except the oblique line section, so as to form the knitted loops, while also the needles b, d, f, h, j, l, o and q of the rear needle bed are used to rib-stitch the knitted loops of the rib jacquard at its part hiding inside in the form of half gauge. Thus, one course of knitted loops is knitted with the needles of the front needle bed, whereas a double course of knitted loops are knitted with the half-gauged needles of the rear needle bed. In the block 1*d*, in order to do the course knitting of the rear body 7 following the course knitting of the front body 5, the course knitting that the knitted loops of the front body 5 at its part hiding inside, which are knitted with the needles of the rear needle bed, are transferred back to the needles of the opposite front needle bed is done.

Block group 2 is in composed of blocks 2*a*, 2*b*, 2*c* and 2*d*.

Next, in the block 2*a*, an array of the knitted loops is made ready for the knitting of the rear body 7 by transferring the knitted loops 7*b* of the rear body at its part hiding inside, which are retained by the needles a, c, e, . . . k, m and p of the rear needle bed, to the needles of the front needle bed.

In the next block 2*b*, the knitted yarn A is moved to the left side, so that the knitted loops in the part Pb1 at the oblique line section in the course 1 of FIG. 2-B are formed with the needles D, E, F, G, L, M, O and P of the rear needle bed and also the knitted loops of the rib jacquard at its part hiding inside are formed in the form of half gauge with the needles a, c, e, g, i, k, m and p of the front needle bed. In the block 2*c*, the knitting yarn B is fed to the needles A, B, C, H, I, J, K and Q of the rear needle bed and the needles a, c, e, g, i, k, m and p of the front needle bed relating to a part Pb2 of the same course except the oblique line section, so as to do the course knitting of the rest of the knit-in jacquard. In the block 2*d*, in order to knit the course of the front body 5 following the course of the rear body 7, the course knitting that the knitted loops of the rear body 7 at its part hiding inside, which are knitted with the needles on the front needle bed, are transferred back to the needles of the opposite rear needle bed is done. By establishing the above-mentioned knitting of the blocks 1 and 2 as basic cycles to be applied to the sequential course knitting and repeating the cycles, the two-color rib jacquard fabric of the tubular body whose front body 5 and rear body 7 are knitted together at their opposite ends can be knitted.

Next, knitting with the four heads flat knitting machine is described below. For the four heads flat knitting machine, it is enough for example that the front body 5 at its outer face or part facing outside of the garment and the front body at its inner face facing inside of the garment inside are knitted with the needles of the lower front needle beds and the needles of the upper rear needle beds, respectively, while the rear body 7 at its part facing outside of the garment and the rear body at its inner face facing inside the garment inside are knitted with the needles of the lower rear needle beds and the needles of the upper front needle beds, respectively. In this case, the body at its outer face facing outside need not be knitted with every other needle of the lower needle beds but the courses of the knitted loops can be knitted with all of the needles of the lower needle beds. The needles of the upper needle beds are then arrayed on an every-other-needle basis so as to be half gauge in response to the gauge of the lower needle beds, and the idle needles of the opposite upper needle beds will be made auxiliary needles for a temporary hold.

In the block diagrams shown in FIGS. 3 and 4, the knitting was described with each step a–d. When a cam box having four lines of knitting cams is used for example, the knitting in the blocks can be done all at once by the cam box being simply traversed once and a round-the-body course knitting for the front body and the rear body can be done by one round run of the cam box. Further, when more knitting cams are used with two yarn feed members for each of the first and second color knitting yarns and are assigned to the knitting of the front body and the knitting of the rear body, respectively, the round-the-body course knitting of the body can be done at once by one traverse of a carriage of the knitting cams, thus providing further increased productivity. In this variant, the yarn feed members are arrayed such that the knitting yarns of the front and rear bodies can intersect each other at both ends of the body so that the front and rear bodies can be connected together at their opposite ends. What is described above simply relates to the basic course formation of knitted loops. When set-in sleeves or raglan sleeves are joined to the body, outside loops at side edges of the body may be tacked to form and knit armholes of a desired shape.

Further, it is noted that though the body of the tubular body knitted with a flat knitting machine is knitted with the wales of the tubular body at its part facing inwardly of the garment being half the gauge of the wales of the tubular body at its part facing outwardly of the garment, the tubular body, when worn, can be reversed so that the part to be the half gauge can be used as the front side of the knitted fabric. Also, though an example of the knit-in jacquard knitted in around the body is taken in the above-mentioned embodiments, the knit-in jacquard may be knitted into the front body only or a specific part of the front or rear body only, for example. Further, it is needless to say that the number of colors used are not necessarily limited to two but may be increased without departing from the scope of the essential characteristics of the invention.

What is claimed is:

1. A method of knitting a knit-in jacquard of a double-jersey weave, using a flat knitting machine such as a rib jacquard or a tubular jacquard, into a tubular body whose front fabric and rear fabric are knitted together at their side edges with the flat knitting machine having at least a pair of first and second needle beds facing each other with a gap, each said needle bed having knitting needles, at least one of the front fabric and the rear fabric having an inner face and an outer face, the method comprising the steps of:

(a) forming a first course of knitted loops of one fabric of said fabrics with the knitting needles of the first needle bed:

(b) transferring knitted loops of an inner face of said one fabric for a knit-in jacquard to be knitted into the knitting needles of the second needle bed facing the first needle bed so that the number of wales of the said one fabric at its inner face is a half of a gauge of the number of wales of the said one fabric at its outer face;

(c) forming a course of knitted loops of the knit-in jacquard by using the needles of the first and second needle beds, said needles retaining the knitted loops of the said one fabric for a knit-in jacquard to be knitted;

(d) transferring the knitted loops of the said one fabric at its inner face formed with the needles of the second needle bed back to the knitting needles of the first needle bed facing the second needle bed; and (e) knitting courses of knitted loops of the other fabric of said fabrics;

wherein in the above steps (b)–(e) are repeated to knit the knit-in jacquard of a double-jersey weave into the tubular knitted body.

2. A method of knitting a knit-in jacquard of a double-jersey weave into a tubular knitting fabric according to claim 1, including assigning the knitted loops to needles of the first and second needle beds, forming the knitted loops for the outer face of the fabric with every other needle of the first needle bed, and forming the knitted loops for the inner face of the fabric with every three needles of the second needle bed opposite to the first needle bed.

3. A method of knitting a knit-in jacquard of a double-jersey weave into a tubular knitting fabric according to claim 2, wherein knitted loops of the fabric at its outer face for the knit-in jacquard to be knitted in are formed with a series of needles of lower and needle beds in one of the pair of the front and rear needle beds and knitted loops of the fabric at its inner facing portion are formed with every other needle of upper needle beds of the other of the pair of the front and rear needle beds, the knitted loops of the knitting fabric at its inner facing portion being transferred between the upper needle beds of the pair of front and rear needle beds.

4. A method of knitting a knit-in jacquard of a double-jersey weave into a tubular knitting fabric according to claim 1, wherein knitted loops of the fabric at its outer face for the knit-in jacquard to be knitted in are formed with a series of needles of lower and needle beds in one of the pair of the front and rear needle beds and knitted loops of the fabric at its inner facing portion are formed with every other needle of upper needle beds of the other of the pair of the front and rear needle beds, the knitted loops of the knitting fabric at its inner facing portion being transferred between the upper needle beds of the pair of front and rear needle beds.

5. A method of knitting a knit-in jacquard of a double-jersey weave into a tubular knitting fabric according to claim 4, including assigning the knitted loops to needles of the first and second needle beds, forming the knitted loops for the outer face of the fabric with every other needle of the first needle bed, and forming the knitted loops for the inner face of the fabric with every three needles of the second needle bed opposite to the first needle bed.

* * * * *